OR 4,308,460

United States Patent [19]
Groh et al.

[11] 4,308,460
[45] Dec. 29, 1981

[54] STORAGE CONTAINERS FOR RADIOACTIVE MATERIAL

[75] Inventors: Edward F. Groh, Naperville, Ill.; Dale A. Cassidy, Valparaiso, Ind.; Leon R. Dates, Elmwood Park, Ill.

[73] Assignee: The United States of America as represented by the United States Department of Energy, Washington, D.C.

[21] Appl. No.: 174,285

[22] Filed: Jul. 31, 1980

[51] Int. Cl.[3] ..... G21F 5/00
[52] U.S. Cl. ..... 250/506
[58] Field of Search ..... 250/506, 507, 515; 176/79, 81

[56] References Cited

U.S. PATENT DOCUMENTS

| | | | |
|---|---|---|---|
| 2,743,372 | 4/1956 | Browne et al. | 250/507 |
| 3,113,215 | 12/1963 | Allen | 250/506 |
| 3,569,714 | 3/1971 | Anderson et al. | 250/507 |
| 3,953,288 | 4/1976 | Johnson | 250/506 |
| 4,084,097 | 4/1978 | Czaplinski et al. | 250/506 |

*Primary Examiner*—Bruce C. Anderson
*Attorney, Agent, or Firm*—Paul A. Gottlieb; Richard G. Besha; James E. Denny

[57] ABSTRACT

A radioactive material storage system for use in the laboratory having a flat base plate with a groove in one surface thereof and a hollow pedestal extending perpendicularly away from the other surface thereof, a sealing gasket in the groove, a cover having a filter therein and an outwardly extending flange which fits over the plate, the groove and the gasket, and a clamp for maintaining the cover and the plate sealed together, whereby the plate and the cover and the clamp cooperate to provide a storage area for radioactive material readily accessible for use or inventory. Wall mounts are provided to prevent accidental formation of critical masses during storage.

8 Claims, 2 Drawing Figures

STORAGE CONTAINERS FOR RADIOACTIVE MATERIAL

CONTRACTURAL ORIGIN OF THE INVENTION

The invention described herein was made in the course of, or under, a contract with the UNITED STATES DEPARTMENT OF ENERGY.

BACKGROUND OF THE INVENTION

Storage containers for radioactive material are common place and widely used to transport spent fuel pins from nuclear powder reactors and to transport radioisotopes for use in medicine and industry. Containers suitable for transporting radioactive material must be designed to withstand severe impact yet retain their integrity to prevent unacceptable nuclear contamination if the container is involved in an accident.

Such transportation type containers are generally heavy and bulky and are inapplicable for use in the laboratory where small amounts of radioactive material must be stored, yet be readily available for inventory or use. Such a laboratory storage container should provide adequate shielding to prevent workers from being exposed to harmful radiation and also to prevent the escape of radioactive material. On the otherhand, because the radioactive material is often used for experimental purposes, the container should be designed for ready access to the material not only for day-to-day experimental use but also for inventory control. Because plutonium as well as enriched uranium is often used in experimental facilities, a criticality problem exists which must be taken into account in the container design to prevent container stacking which may result in a critical mass being formed. Accordingly, containers suitable for laboratory use which meet all the requirements described above would generally not be suitable for transporting radioactive material by common carrier.

Representative literature pertinent to transportation containers include the Allen U.S. Pat. No. 3,113,215 issued Dec. 3, 1963 for Cask Construction For Radioactive Material. This patent discloses a cask construction for radioactive material including a screwed down top plate with a gasket seal. The Bonilla et al. U.S. Pat. No. 3,229,096 issued Jan. 11, 1966 for Shipping Container For Spent Nuclear Reactor Fuel Elements discloses a container including a screwed down cover with a vent and with a ring handle.

The Lecuyer U.S. Pat. No. 3,560,749 issued Feb. 2, 1971 for Container Means For a Radioactive Element discloses a container having interchangeable storage bodies formed of a radioactive shielding material.

The Peterson et al. U.S. Pat. No. 3,731,101 issued May. 1, 1973 for Shipping Container For Radioactive Material discloses a container with a gasket seal at the top of the container and screws for maintaining the top in place.

The Backus U.S. Pat. No. 3,770,964 issued Nov. 6, 1973 for Shipping Container for Radioactive Material discloses a cask with a screw down top plate and annular gasket sealing same.

The Czaplinski et al. U.S. Pat. No. 4,084,097 issued Apr. 11, 1978 for Shielded Container discloses a container having a handle pivoted thereto which includes means for measuring the radioactivity of the solution stored therewithin.

Other patents generally pertinent to the subject matter include the Anderson et al. U.S. Pat. No. 3,569,714 issued Mar. 9, 1971 for Protected Radioisotopic Heat Source which discloses a protected radioisotopic heat source including a cover fitted on a plate on which the source rests and the Johnson U.S. Pat. No. 3,953,288 issued Apr. 27, 1976 for Gas Venting discloses containers housing radioactive material which utilize the passageways between interbonded impervious laminae.

SUMMARY OF THE INVENTION

The present invention relates to a storage system for storing radioactive material in the laboratory particularly adapted fior plutonium and enriched uranium which segregates the radioactive material preventing formation of critical masses, yet provides easy access thereto.

An important object of the present invention is to provide a fuel storage system comprising a flat base plate having a groove in one surface thereof and a hollow pedestal extending perpendicularly away from the other surface thereof, a gasket in the groove, a cover having a filtered vent therein dimensioned to fit over the one surface of the plate and to form therewith a fuel storage area, the cover having a flange overlying the groove and the gasket, and clamp means for maintaining the cover and the plate together in sealed relation, whereby the plate and the cover and the clamp means cooperate to provide a storage system for radioactive material readily accessible for use or inventory.

A further object of the present invention is to provide a fuel storage system of the type set forth in which vertically spaced apart wall mounting receptacles are provided for storing the system at preselected points along a wall.

Another object of the present invention is to provide a fuel storage system of the type set forth including a floor stand including a flat plate and upstanding shaft for accepting the hollow pedestal to allow the system to be used in the laboratory where access to the stored radioactive material is desired.

The invention both as to the attainment of its aforesaid objects and the operation thereof may more readily be understood by reference to the following specification and the accompanying drawings, in which:

DETAILED DESCRIPTION OF THE INVENTION

Figure 1:
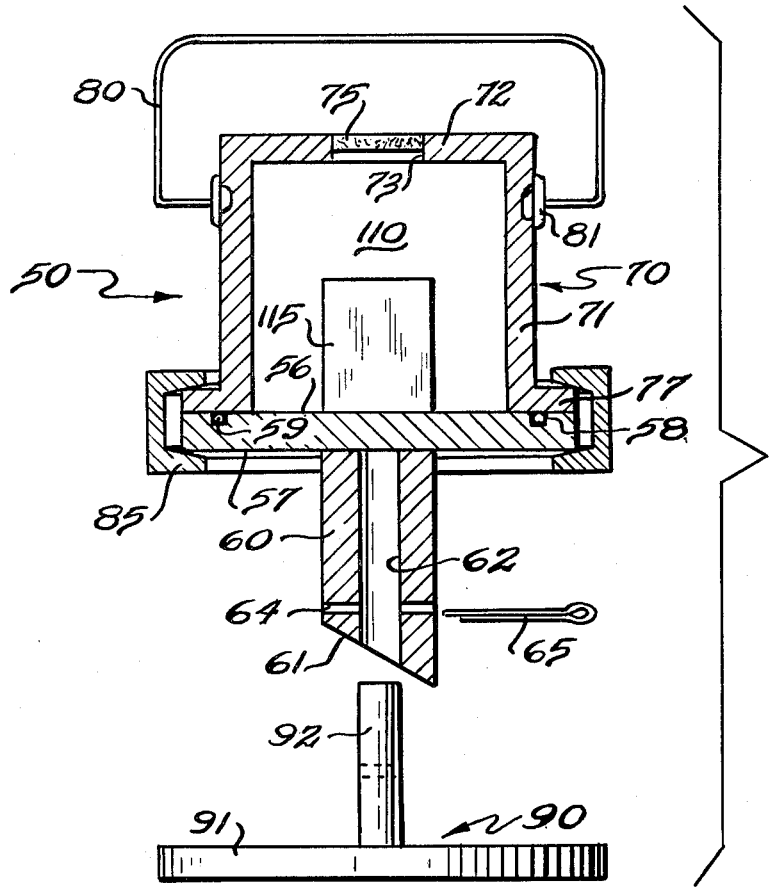
FIG. 1 is an exploded side elevational view partly in section of a fuel storage system including a floor stand therefor.
Figure 2:
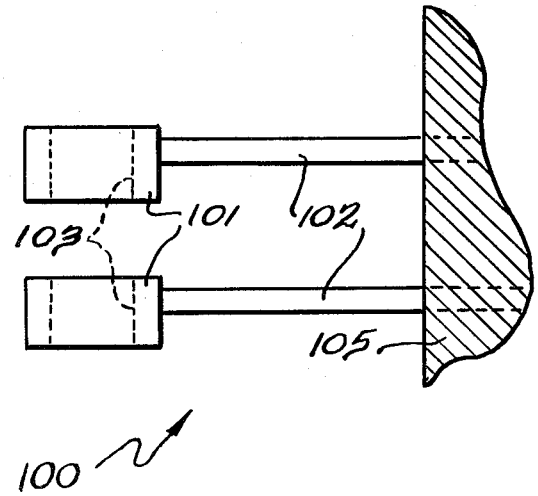
FIG. 2 is side elevational view partly in section of a wall mount apparatus.

Referring now to the drawings, there is shown a fuel storage system 50 which includes a circular base plate 55 having opposed upper surface 56 and lower surface 57. A circular groove 58 is in the upper surface 56 spaced inwardly from the edge of the circular plate 55. An O-ring gasket 59 is positioned in the groove 58 and may be made of any suitable material, such as neoprene.

Depending from the lower surface 57 of the circular base plate 55 is a pedestal 60 which is cylindrical and has a beveled end 61 and a central aperture 62 extending the length thereof, the pedestal extending perpendicularly from the circular base plate 55. A cotter pin hole 64 extends transversely of the pedestal 60 near the beveled end 61 thereof and is provided with a cotter pin 65.

A cover 70 has a cylindrical body portion 71 closed by a flat top portion 72 having a circular aperture 73 therein. The aperture 73 is closed by a filter 75 which may be porous stainless steel having openings about 5 microns in diameter. The cover 70 and more particularly the cylindrical body portion 71 terminates in an annular flange 77 having the same radial dimension as the circular plate 55, the annular flange being dimensioned to overlie the circular plate 55 and more particularly to be in registry with the circular groove 58 and the O-ring gasket 59 positioned therein. The cover 70 further includes a handle 80 pivotally mounted as at 81 to the cover.

The cover 70 and the circular plate 55 are maintained in sealed relation by means of a V-clamp 85 which provides quick disconnecting of the cover 70 and the base plate 55 when access to the radioactive material stored in a nuclear material fuel box 115 positioned in the storage area 110 defined by the circular base plate 55 and the cover 70.

The beveled end 61 of the pedestal 60 prevents balancing of the storage system 50 on the pedestal 60 which would result in an unstable condition. The beveled end 61 also facilitates introduction of the pedestal onto a stand 90 which includes a flat base plate 91 and perpendicularly upstanding rod 92, the rod being dimensioned to receive the pedestal 60 thereover. The stand 90 is used in the laboratory when the nuclear material present in the fuel box 115 is to be removed for experimental purposes or for inventory. When the system 50 is used for out of the way storage purposes, a wall mount 100 is provided. The wall mount 100 includes two vertically spaced apart collars 101 each attached to an arm 102 connected to a wall 105.

Each of the collars 101 has a vertically extending aperture 103 therein aligned and dimensioned to receive the pedestal 60 of the storage system 50 therethrough. In this manner, individual ones of the storage systems 50 may be stored at preselected positions along the wall 105 thereby to prevent accidental assembly of a critical mass.

In a constructional example of the present invention, the nuclear fuel box 115 is dimensioned to carry plutonium plates varying in sizes from 2"×2"×2" to 2"×2"×8" or enriched uranium 235 plates varying in size from 2"×2"×2" to 2"×3". The nuclear fuel box 115 may be made of any suitable shielding material such as lead. The object is to make the fuel storage system 50 as small as possiible for weight purposes to facilitate easy transport by operating personnel. The preferred construction material is, although not necessarily, cast aluminum with the base plate 55 being ¾ inch thick and 4 15/16 inches in diameter. Similarly, the cover 70 is cast aluminum of about ⅛ inch thickness with the flange 77 being thicker. The cover 70 is about 6¾ inches high and has a diameter of 4 15/16 inch to match that of the base plate 55. The pedestal 60 is about 1½ inches in diameter and approximately 2½ inches long. The stand 90 as well as the wall mount 100 must be dimensioned to accommodate the specific fuel storage system 50, and the sizes may vary from the specific example given. Another advantage of the present invention is that when nuclear material is stored in the storage system 50 and mounted on a wall mount 100 it is substantially tornado or earthquake proof, the cotter pin 65 serving to lock the system 50 in place on the wall mount 100. The filter 75 is preferably made of a porous stainless steel metal with the pores being about 5 microns in diameter, thereby allowing gases to escape but preventing radioactive particles from contaminating the atmosphere. In general, only one V-clamp 85 is necessary to maintain the cover 70 in sealed relation with the base plate 55, but more may be used if deemed necessary. The V-clamp 85 is of the type that is maintained in the clamped position by a threaded member (not shown) but various alternatives well known to those skilled in the art may be used.

It will be seen that there has been provided a fuel storage system which is light weight and easily accessible. The system is not designed nor is it capable of functioning as a transport container but is specifically designed for use in a laboratory where containment is necessary yet relatively quick and easy access to the nuclear material is required. When mounted on a wall 100, the fuel storage system 50 of the present invention is substantially earthquake and tornado proof and ensures against inadvertent assembly of any critical masses.

While there has been illustrated what at present is considered to be the preferred embodiment of the present invention, it will be understood that various modifications and alterations may be made therein without departing from the scope of the present invention, which is intended to be covered in the claims appended thereto.

The embodiments of the invention in which an exclusive property or privilege is claimed are defined as follows:

1. A radioactive material storage system comprising a flat base plate having a groove in one surface thereof and a hollow pedestal extending perpendicularly away from the other surface thereof, a gasket in said groove, a cover having a filter for filtering out radioactive gases therein dimensioned to fit over said one surface of said plate and to form therewith a storage area, said cover having a flange overlying said groove and said gasket, and clamp means for maintaining said cover and said plate together in sealed relation, whereby said plate and said cover and said clamp means cooperate to provide a storage area for radioactive material readily accessible for transportable use or inventory.

2. The storage system of claim 1, wherein said base is circular and said groove is circular and spaced radially inwardly from the plate edge, said cover is cylindrical and has a radially outwardly extending flange having substantially the same diameter as said plate.

3. The storage system of claim 1, wherein said filter is in the top of said cover and includes porous stainless steel having openings not greater than about 5 microns.

4. The storage system of claim 1, wherein the hollow pedestal is cylindrical with the free end thereof beveled to prevent independent standing.

5. The storage system of claim 1, and further including vertically spaced apart wall mounted receptacles for receiving therethrough said pedestal.

6. The storage system of claim 5, and further comprising a transversely extending hole in said pedestal and a locking pin dimensioned to pass through said hole to prevent inadvertent removal of said storage system from said wall mounted receptacles.

7. The storage system of claim 1, and further including a floor stand having a plate and an upstanding shaft dimensioned to receive the hollow pedestal thereon.

8. The storage system of claim 1, wherein said clamp means is a quick connect and disconnect clamp facilitating easy access to radioactive material in said storage system.

* * * * *